United States Patent [19]

Wiese

[11] 4,154,418

[45] May 15, 1979

[54] ONE-PIECE CABLE STRAP

[75] Inventor: Heiner Wiese, Hamburg, Fed. Rep. of Germany

[73] Assignee: ITW Ateco GmbH, Norstedt, Fed. Rep. of Germany

[21] Appl. No.: 885,938

[22] Filed: Mar. 13, 1978

[30] Foreign Application Priority Data

Apr. 21, 1977 [DE] Fed. Rep. of Germany ..... 2717622

[51] Int. Cl.[2] ..... F16L 3/22; F16L 33/00

[52] U.S. Cl. ..... 248/68 R; 248/74 PB; 24/16 PB

[58] Field of Search ..... 24/16 PB, 30.5 D, 206 A; 248/74 PB, 68 R

[56] References Cited

U.S. PATENT DOCUMENTS

| | | | |
|---|---|---|---|
| 2,977,145 | 3/1961 | Rifkin | 248/74 PB |
| 3,214,808 | 11/1965 | Litwin | 248/74 PB |
| 3,463,427 | 8/1969 | Fisher | 24/16 PB |
| 3,550,219 | 12/1970 | Van Buren | 248/74 PB |
| 3,618,173 | 11/1971 | Schwartz | 24/16 PB |
| 3,819,139 | 6/1974 | Hanger | 24/16 PB |
| 3,973,293 | 8/1976 | Noorily | 24/16 PB |
| 4,079,485 | 3/1978 | Collier | 24/16 PB |

*Primary Examiner*—Bernard A. Gelak

*Attorney, Agent, or Firm*—J. R. Halvorsen; R. W. Beart

[57] ABSTRACT

A one-piece cable strap of flexible plastic material including a socket at one end and a toothed central region along a length and adapted to be passed through the socket. The socket includes locking pawls for engaging the teeth.

5 Claims, 4 Drawing Figures

ONE-PIECE CABLE STRAP

The invention relates to a one-piece cable strap of flexible plastic material which comprises a toothed central region and at one end of which there is arranged a socket for the strap provided with a push-through opening, there being a locking pawl disposed in the push-through opening, which locking pawl, by an inclined portion, forms with the opposite wall portion of the push-through opening a push-in channel portion narrowing in the direction of pushing in, and interengages with the tooth gaps of the strap pushed into the push-through opening.

Such cable straps are know to the prior art, i.e. U.S. Pat. Nos. 3,049,771; 3,900,923 and 3,886,630. The hook-shaped locking pawl is bevelled over the entire front face, and forms a funnel-shaped push-in channel, while the locking pawl is connected by at least one bar with the wall of the push-through opening opposite to the front side. What is achieved with the help of a construction of this kind is that relatively slight pull-through forces are required upon threading and tightening of the cable strap. This depends primarily on the easy deformability of the locking pawl in one direction, while in the releasing direction it is exceptionally rigid.

It has appeared that, in many cases of use, higher loading requirements are applied to a cable strap than can be fulfilled by a known cable strap. Moreover, problems arise with the cable strap if the purpose is set that the tightening of the cable strap should be carried out through an opening in a carrier element.

The purpose of underlying the invention is to provide a one-piece cable strap of flexible plastics material which is simple to make, which makes possible a non-releaseable connection for very high loadings.

This purpose is solved according to the invention in that the axis of the push-through opening extends approximately parallel to the axis of the strap extension at the socket.

Whereas, in known cable straps the axis of the strap in the region of the transition to the socket extends substantially perpendicular to the push-in direction, with the cable strap according to the invention provision is made to arrange the push-in channel parallel to the direction of the strap, so that in the region of the entry of the push-through opening the strap is led back parallel to itself.

On the basis of the constructional features of the cable strap according to the invention, an extraordinarily high loading potential is achieved, which exceeds that of the known cable straps. Moreover, the socket is simple to make and provided with restricted dimensions, so that it is possible first to introduce the cable strap through an opening in a carrier element, to surround a bundle of cables, and to lead back the end of the cable strap through the opening in the carrier element and through the socket. Thereupon the cable strap can be pulled firmly tight with the help of a pair of assembly pliers, and finally cut off.

Particularly high holding forces are achieved if, according to a development of the invention, provision is made that at least two, preferably three, locking pawls are provided behind one another in the push-through opening. It will be understood that the spacing of the locking pawls corresponds to the intervals between tooth gaps of the toothed region of the strap.

In a further development of the invention, provision is made that in the entry region of the push-through opening, on the side of the socket which has the locking pawls, a flap-shaped tongue is formed extending parallel to the axis of the push-through opening. This tongue has the purpose to protect the free end of the cable strap, which is to be tightened, against damage during the tightening operation. If the cable strap is pulled tight, the back of the cable strap end which is to be pulled tight rubs against the edges of the opening in the carrier element. This has the consequence that the assembly pliers, which cut off the free end of the strap after attainment of a predetermined tightening leverage, are not in the position to provide the necessary required fit for the connection, because, by the friction on the opening with edges, a tightened force is simulated, which in truth is not yet attained as regards the strapping of the bundle of cables. The flap-shaped tongue ensures that the strap end which is to be tightened cannot come into contact with the edge of the opening, and thus good sliding through and tightening can always occur.

An example of an embodiment of the invention will be described in more detail below with reference to drawings.

Figure 1:
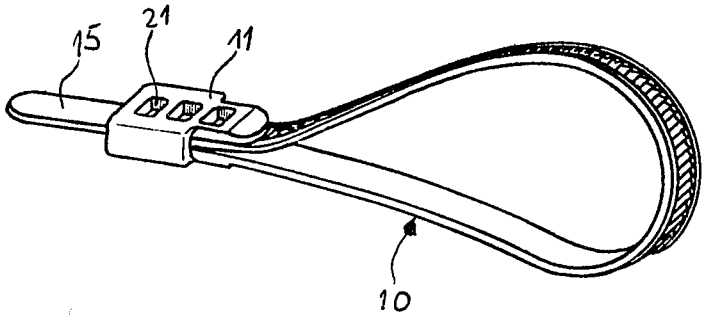
FIG. 1 shows in perspective the cable strap according to the invention with the free end of the strap introduced into the socket.

On a cable strap indicated in general at 10 there is formed integrally a flat rectangular-shaped socket 11. It includes a push-through opening 12, which matches the cross section of the strap 10, which includes a central toothed region 13, a portion 14 connecting with the socket 11, and an inserting end 15.

Figure 2:
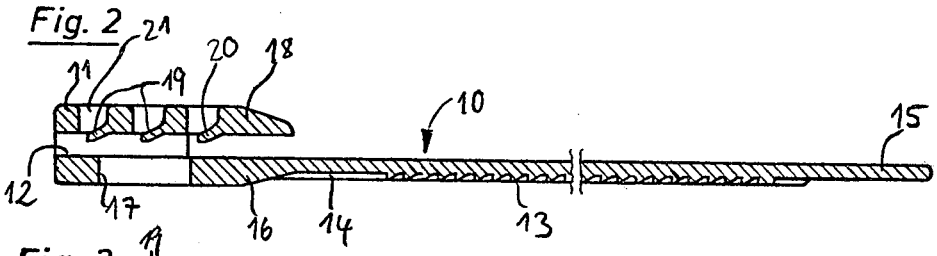
FIG. 2 shows in section the cable strap according to FIG. 1 in open condition.

As one can see particularly from FIG. 2, the connecting portion 14 lies in the same plane as the side of the socket 11 connected with it, so that in the open condition the corresponding wall of the push-through opening 12 and the upper face of the strap 10 form a continuous flat surface. The toothing of the toothed region 13 lies on the opposite face of the strap.

Between the associated socket side and the connecting portion there is provided a transition portion 16 gradually tapering towards the strap 10. The said side of the socket also has an opening 17 penetrating into the push-through opening 12.

Figure 3:
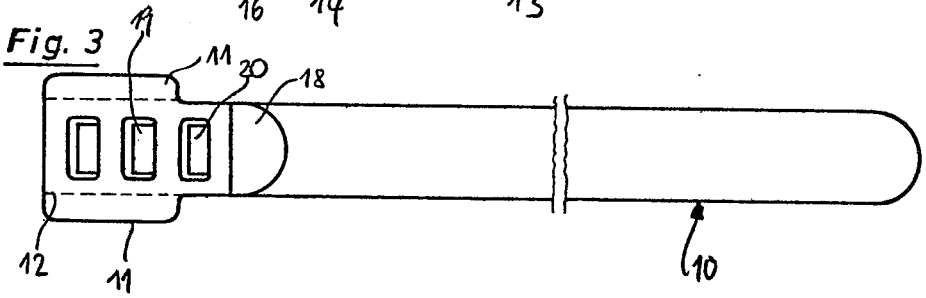
FIG. 3 shows a plan of the cable strap according to FIG. 2.

As one can further see from FIG. 2, a flap-shaped tongue 18 is formed in the entry region of the push-through opening 12 on the opposite side of the socket. This side has two tooth-like locking pawls 19, while the tongue has a similarly formed locking pawl 20. The locking pawls 19, 20 are inclined in the direction of the push-through opening 12, and thus progressively narrow the push-in channel. Apertures 21 at the back of the locking pawls 19, 20 make possible an outward swinging of the locking pawls upon pushing in of the toothed strap. One can see from FIG. 3 that the locking pawls 19, 20 can move in the apertures 21 with clearance on all three free edges. Moreover, it appears from FIG. 3 that the tongue 18 which tapers towards its free end is rounded at its end and has only the width of the strap 10 while the socket 11 is made wider than the thickness of the strap at both sides.

Figure 4:
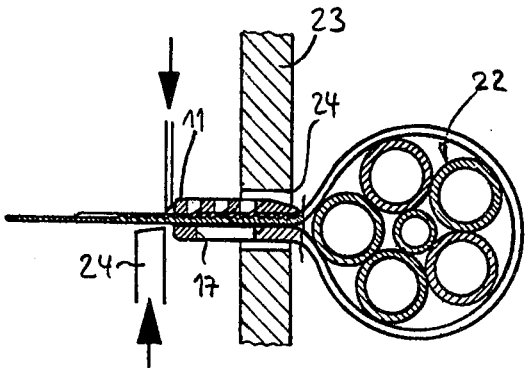
FIG. 4 shows a closed cable strap, partly in section, during the tightening operation.

In FIG. 4 there is shown a carrier element 23 with an opening 24. One can see in this figure the advantageous method of mounting of the cable strap. The cable strap 10 is first inserted through the opening 24 in the carrier element 23 and then surrounds a bundle of cables 22. The insertion end 15 of the cable strap is led back through the opening in the carrier element 23 and inserted into the socket of the cable strap. With the help of a pair of assembly pliers, not shown, the cable strap is tightened firmly. The flap-shaped tongue 18 ensures that the strap end to be tightened does not come into engagement with the edges of the opening 24, so that good sliding and pulling tight take place. With the help of a cutting tool 24, only indicated schematically, the projecting end of the cable strap is cut off directly against the socket 11.

I claim:

1. A one-piece flexible plastic cable strap including a socket and an integral elongated strap, said socket including a generally rectangular body portion greater in lateral dimension than the width of said strap and having a pass-through opening complimentary to said strap, a plurality of pawls extending from one side into said opening, said opening being disposed substantially parallel to the connection of said strap to said body, a pair of tongue elements extending from one end of said socket body and positioned on opposite sides of said pass-through opening, said elements having a width substantially equal to said strap, said strap connected along a transverse line to one of said elements and further includes a plurality of teeth disposed on one surface thereof in the central region intermediate the extremities of said strap, said teeth adapted to be engaged by said pawls when the free end of said strap is bent back upon itself and fed through said opening adjacent its line of connection, whereby said strap forms a loop with portions thereof lying in parallel juxtaposed relationship.

2. The cable strap according to claim 1 characterized in that at least two, preferably three, locking pawls (19,20) are provided in spaced relation in the pass-through opening (12).

3. The cable strap according to claim 2 characterized in that the locking pawls (19,20) are integrally formed with that side of the socket (11) which is disposed opposite the side retaining the strap (10) and in that the teeth of the toothed region (13) are disposed on the outside of the strap.

4. The cable strap according to claim 3 characterized in that the socket (11) is provided with an aperture (21) above the locking pawls (19,20).

5. The cable strap according to claim 4 wherein said socket has a predetermined lateral extent greater than the width of said strap in combination with an apertured support member adapted to accept said strap and tongue elements through said aperture which has a major dimension greater than said strap width but less than said predetermined lateral extent of said socket whereby said socket is positioned generally perpendicular adjacent one surface of said support while said tongue elements and strap pass through said aperture and extend beyond the opposite surface of said support to retain at least one workpiece parallel to and adjacent said opposite surface of said support.

* * * * *